US005180887A

United States Patent [19]

Agabekov

[11] Patent Number: 5,180,887

[45] Date of Patent: Jan. 19, 1993

[54] ELECTRIC SUPPLY RAMP WITH SUPPORT PROFILE

[76] Inventor: Branka Agabekov, 73, route de Thonon, Vesenaz, Switzerland

[21] Appl. No.: 711,658

[22] Filed: Jun. 6, 1991

Related U.S. Application Data

[63] Continuation-in-part of Ser. No. 452,121, Dec. 15, 1989, Pat. No. 5,038,257.

[30] Foreign Application Priority Data

Dec. 20, 1988 [CH] Switzerland ..... 4705/88 9

[51] Int. Cl.[5] ..... F21V 21/00; H01B 5/00; H01R 25/16

[52] U.S. Cl. ..... 174/72 B; 174/72 R; 362/219; 362/225; 362/249; 439/115

[58] Field of Search ..... 362/219, 225, 217, 227, 362/249; 439/115, 239, 744, 746, 787, 796, 721; 174/72 B, 72 R

[56] References Cited

U.S. PATENT DOCUMENTS

| | | | |
|---|---|---|---|
| 3,995,103 | 11/1976 | Gehrs et al. | 174/72 B |
| 4,158,221 | 6/1979 | Agabekov | 362/219 |
| 4,293,752 | 10/1981 | Koenig | 174/117 A X |
| 4,382,156 | 3/1983 | Jodoin | 174/72 B |
| 4,521,838 | 6/1985 | Agabekov | 362/219 |
| 4,569,568 | 2/1986 | Agabekov | 439/110 X |
| 4,580,203 | 4/1986 | Betsch et al. | 362/294 |
| 4,723,199 | 2/1988 | Freed et al. | 439/743 X |
| 4,858,088 | 8/1989 | Agabekov | 362/219 X |
| 4,867,696 | 9/1989 | Demler, Jr. et al. | 174/72 B X |
| 5,027,262 | 6/1991 | Freed | 439/115 X |
| 5,038,257 | 8/1991 | Agabekov | 362/219 |
| 5,041,953 | 8/1991 | Dannatt | 362/219 |
| 5,055,059 | 10/1991 | Logstrup | 174/72 B X |

FOREIGN PATENT DOCUMENTS

| | | | |
|---|---|---|---|
| 43931 | 6/1981 | European Pat. Off. | 174/72 B |
| 2912944 | 10/1980 | Fed. Rep. of Germany | 174/72 B |
| 603981 | 4/1960 | Italy | 362/219 |

*Primary Examiner*—Morris H. Nimmo
*Attorney, Agent, or Firm*—Ostrolenk, Faber, Gerb & Soffen

[57] ABSTRACT

An electrifiable ramp for use in supporting and electrifying lamps, or the like current consuming elements. A top and a bottom conductive strip are superimposed and insulated from each other. Respective conductive and supporting plates are folded up from both strips to extend in the same direction above the top strip, with the plates from the bottom strip extending through openings in the top strip. A rail profile has a receiving channel which receives the superimposed conductive strips slid into the channel. The conductive strips are insulated from the rail, e.g. by the rail being of insulating material, the rail being of anodized aluminum and/or the conductive strips being coated with insulating material. The rail may have side wings that extend up past the electrical element supporting plates to hide access to and viewing of the lamps or the like element supported on the plates.

19 Claims, 1 Drawing Sheet

ELECTRIC SUPPLY RAMP WITH SUPPORT PROFILE

CROSS REFERENCE TO RELATED APPLICATION

This is a continuation in part of application Ser. No. 452,121, filed Dec. 15, 1989, now U.S. Pat. No. 5,038,257.

BACKGROUND OF THE INVENTION

The present invention relates to an electric supply ramp for current consuming devices such as illuminating systems.

A known electric feed ramp employs a succession of pairs of electric contacts intended to receive a current consuming element. Such electric feed ramp includes metallic conductive strips with protrusions forming the electric contacts and passing through slots provided in an insulating support.

Swiss Patent 599,501 describes an illuminating ramp having a support with wings that form an angle of 90° with each other. Metal strips are mounted on the inner surfaces of the wings. Such metal strips comprise L-shaped clips fastened alternately in pairs at predetermined distances on one and the other of the metal strips in order to hold the lamps mounted along the axis of the profile.

From Swiss Patent 652,537 the possibility is known of replacing the L-shaped clips by tabs which are cut out in the direction of the strip and folded 90°, the end of the tab having a hole intended to position an electric contact of a current consuming element. The metal strips are fastened on the wings by means of rivets.

SUMMARY OF THE INVENTION

The present invention is directed to simplifying the mounting of the components of known electric supply ramps and comprises an electric supply ramp having a succession of pairs of electric contacts, the ramp comprising at least two conductive strips having, at predetermined distances along the strips, conductive plates upstanding at 90° to both strips and all extending in one direction. The free ends of the conductive plates are arranged in such a manner as to position, at least indirectly, the electric contacts of current consuming elements, like light bulbs.

The conductive strips are superimposed one over the other and are electrically insulated from each other in any of a number of ways, including their being held spaced apart, or an insulating layer or body being disposed between them or an insulating layer being defined on one or both of the them. In known manner, such an applied insulating layer may be provided on a strip by electrostatic powdering and baking thereafter. The insulating layer between the conductive strips may be an adhesive layer that separates the strips while holding them together. Then one or both of the strips may be covered by an insulating body.

The top conductive strip and the insulating layers or bodies overlying the bottom conductive strip have passage slots through them for the through passage of the plates of the bottom conductive strip.

The upstanding contact plates each have a free end and means are located generally toward the free ends of the contact plates for positioning, at least indirectly, an electric contact of a current consuming element. In one form, the free end regions of the contact plates may simply have a hole or opening through them in which the electric contact is installed. In a modified version, the free ends of the plates are cut for defining three parallel upright support legs, one of which is deformed out of the plane of the plate, e.g. by being embossed, and the legs together define an assembly for supporting a conductor of a current consuming element, for example a loop contact at the end of a light bulb. Where it is desired to provide support legs at the free ends of contact plates that have been preformed without support legs, an additional rider piece is attached on each contact plate. The upper end of the attached rider piece is formed with the three legs and for the same purpose.

In one embodiment, an intermediate insulating body in the form of a flat strip is arranged between the two superimposed conductive strips. That insulating separation between the two conductive strips may be provided by an adhesive layer between them. In another preferred embodiment, the insulating body comprises a covering applied to each metallic conductive strip, with the exception of their upstanding contact plates. The insulating covering layer is obtained by electrostatic powdering and then baking to define the layer. As an alternative, the two conductive strips may be covered by the insulating body and then be simply juxtaposed. They may be juxtaposed after they are coated or even beforehand, so long as there is some insulating means, such as an insulating layer, between the two conductive strips before they are coated.

The distinguishing feature of the present invention is the provision of an elongate profile shaped for receiving and holding the combined, superimposed conductive strips In particular, the profile may be insulated from the conductive strips and may be comprised of an insulating material or may be coated with such a material. The insulating profile may even be comprised of aluminum Then the conductive strips and the insulating body over them are insulated from the aluminum profile. Either the strips are coated or, preferably, the profile is anodized and the applied coating insulates the strips.

The conductive strips are first assembled together and themselves perhaps covered in an insulating material or an insulating body. Then the combined strips are together introduced into the insulated profile which holds and positions them. In one embodiment, the profile has a channel comprised of slots into which the combined conductive strips are slid. In another embodiment, the profile additionally has lateral wings which extend up past the sides of the upstanding contact plates and past the object powered by those plates, e.g. lamps supported there, and the wings mask direct lateral view of the lamps. The profile provides a support for the combined conductive strips by which those strips can be mounted where required. By appropriate shaping of the profile, e.g. by curving it or bending it around a pole, the entire assembly of strips, profile and current consuming devices can be positioned where needed.

Other objects, features and advantages of the present invention will be understood from the following detailed description of an embodiment thereof, with reference to the drawings.

DESCRIPTION OF THE PREFERRED EMBODIMENTS

Figures 1, 2, 3, 4, 5, 6, 7:
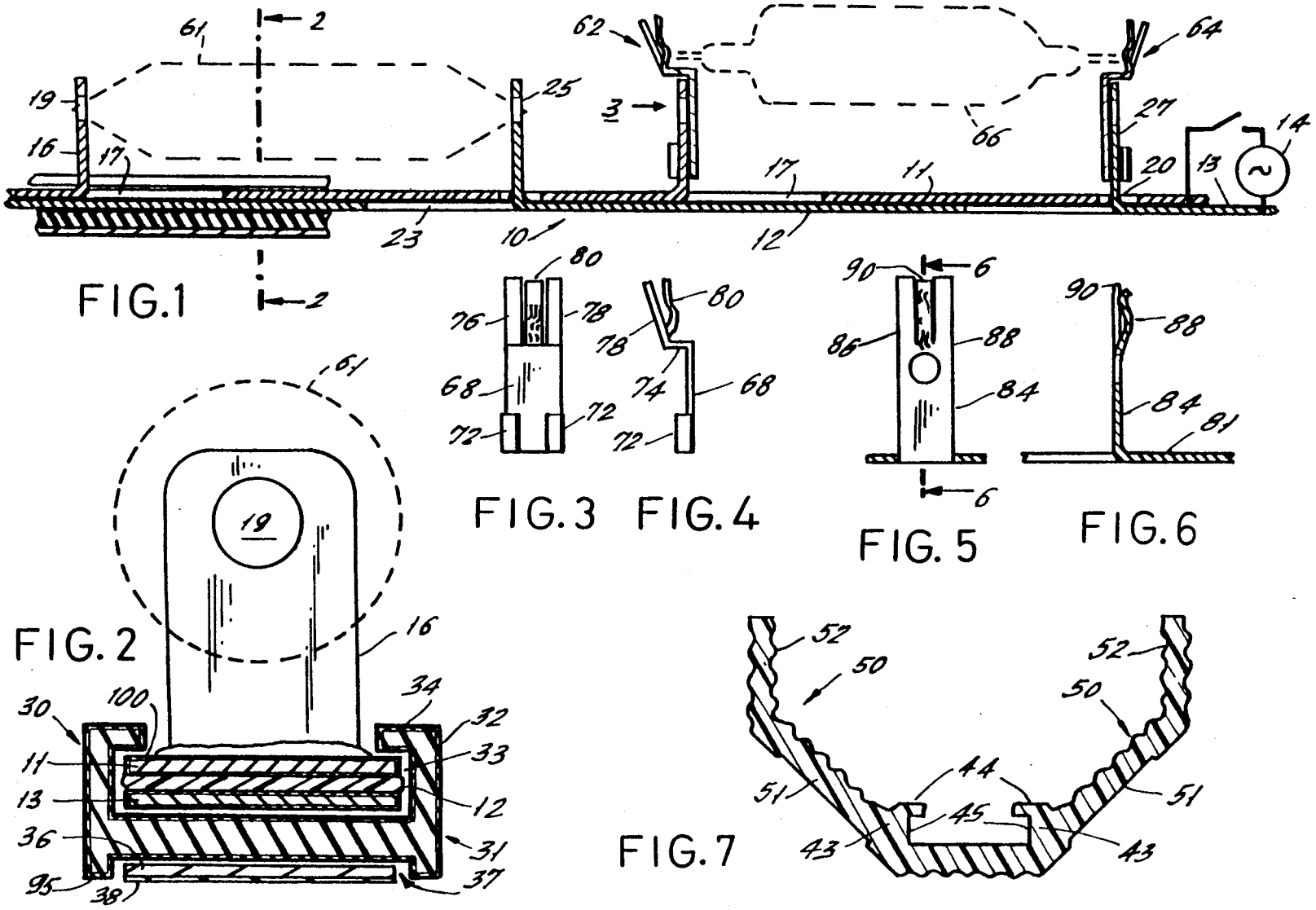
FIG. 1 is a longitudinal, cross-sectional, elevational view of a ramp of the invention.
FIG. 2 is a transverse section through the assembled ramp along with one embodiment of an insulating profile for the ramp, taken between the arrows II—II of FIG. 1.
FIG. 3 is a front view of a lamp contact and a support rider for use with the ramp.
FIG. 4 is a side view of the support rider.
FIG. 5 is a front view of an alternate form of contact plate for the ramp.
FIG. 6 is a side view of the alternate contact plate.
FIG. 7 is a cross-section through another insulating profile.

For observing certain features of the conductive strips shown herein from other perspectives, the disclosure of above noted parent U.S. application No. 452,121, filed Dec. 15, 1989, now U.S. Pat. No. 5,038,257 is incorporated herein by reference.

Referring to FIG. 1 hereof, the ramp 10 includes a top conductive strip 11 and a bottom conductive strip 12 superimposed below the strip 11. A layer 13 of adhesive material, which is also electrically insulating, is interposed between the strips 11 and 12 so as to avoid a short circuit.

The top conductive strip 11 is conventionally connected to one terminal of a conventional power supply 14 while the bottom strip 12 is conventionally connected to the other terminal of the power supply.

At uniformly spaced intervals along its length, the top strip 11 includes a plurality of upstanding contact plates 16,26 which are integral with and are bent up about 90° from the strip, which leaves a respective cut opening 17 in the strip 11 from which each plate 16 has been removed. Each plate 16 has a round opening 19 toward its free top end which opening can receive an end terminal of a festoon lamp 61 shown at the left in FIG. 1, or the like current consuming element, which is supported and electrically powered by the conductive strips.

The top conductive strip 11 has a plurality of smaller size passage slots 20 defined in it, also at uniformly spaced intervals, for passage of the upstanding contact plates 22 from the bottom conductive strip 12. The passage slots 20 are sufficiently wide across the strip 11 and long along the strip 11 as to prevent the periphery of a slot 20 from contacting the respective plate 22 which extends through the opening.

The bottom conductive strip 12 has a corresponding plurality of uniformly spaced plates 22,27 which are integral with and are bent up from the strip 12 at about 90°, to extend up in the same direction as the plates 16. The plates 22 are formed on the bottom strip 12 at locations corresponding to the passage slots 20 through the top strip 11 so that the plates 22 will project through those slots and with clearance space around the plates to prevent electrical contact with the strip 11. The plates 22 are taller than the plates 16 by about the height of the strip 11 plus the layer 13 so that the plates 22 will stand at about the height of the plates 16 above the first strip 11. The folding up of the plates 22 leave cut openings 23 in the bottom strip 12 from which the plates 22 have been removed. Like the plates 16, each plate 22 has an opening 25 near its free top end for receiving the terminal of the festoon lamp 61 or other current consuming element, which is powered from the conductive strips. Mounting of a festoon lamp, or the like, in the plate openings 19 and 25 can be seen in above noted U.S. Pat. No. 5,058,257, incorporated by reference.

In practice, the distance between a cooperating pair of first and second upstanding plates 16 and 22 which are together intended to both support and electrify a light bulb, corresponds to the standard length of a commercial festoon bulb, for instance 40 mm. The lamps are spaced apart by the spacing of neighboring upstanding plates 22 and 16. Upstanding plates 26 and 27, which are identical to upstanding plates 16 and 22, respectively, are shown associated with lamp holding riders 62 and 64. These riders are attached to the upstanding plates 26, 27, respectively, to provide a support for the terminals of the different Xenon lamp 66. As shown in FIGS. 3 and 4 as well as FIG. 1, each rider 62 or 64 includes a body 68 with a pair of folded over clip tabs 72 at its bottom end. The tabs 72 are wrapped around the side edges and extend partly over the surface of the plates 26, 27 for holding the riders securely on the plates. The tabs may be crimped tight against the plates. At the top of the body 68, there is a sideward projecting clip support 74. Upstanding from the support 74 there is an upper end portion of the rider, which is comprised of the two straight upwardly projecting legs 76, 78 and the central leg 80 which is deformed by being bent out of the plane of the upper end portion of the rider on the contact plate. For example, the leg 80 is embossed into a slightly curved shape. The central leg 80 is deformed and embossed so as to constitute a flexible spring to receive the end support metal contact loop of a Xenon lamp 66 which is supported at the legs 76, 78, 80.

FIGS. 5 and 6 illustrate an alternate design for the contact plates extending up from the conductive strips. That design of the conductive plates corresponds to the design of the riders shown in FIGS. 3 and 4 and at the right in FIG. 1. The conductive plate 84 projects up from the conductive strip 81, just like the conductive plate 16 in FIG. 1. The upper end of the conductive plate 84 is cut into three upstanding legs, like the upper free end portion of the contact plate rider 62, for defining the two outer legs 86, 88 and the central leg 90 of the plate 84. Similar to the contact plate riders 62, 64, the central leg 90 of the plate 84 is deformed by being embossed so as to define a flexible spring for receiving the contact loop of the lamp 66.

Although the following description relates to the conductive strips 11 and 12 and the upstanding contact plates 16 and 22, it is apparent that it applies to the contact plates 26 and 27 with the riders 62, 64 thereon and to the contact plates 84.

As can be seen in FIG. 1, the plates 16 are folded up from the top strip 11 toward the left in FIG. 1 while the plates 22 are folded up from the bottom strip toward the right, that is, the plates on the strips 11 and 12 are folded up in opposite directions. This can be accomplished by the conductive strips 11 and 12 being essentially identical, except for the lengths of their plates 16 and 22, and being oriented to extend in opposite directions.

In FIG. 2, the top and bottom conductive strips 11 and 12 are uncoated. But they may each be coated with an insulating layer, e.g. they may be electrostatically powdered and baked, either individually, or together once assembled together, which provides an insulating coating over them.

Referring to FIGS. 1 and 2, the conductive strips 11 and 12, once assembled into the integrated 11, 12, 13 unit shown in FIG. 1, are assembled into a continuous, elongate extruded profile 30 of at least about the length of the strips 11 and 12. The profile has a constant cross-section. It may be extruded. The profile may be of plastic material or other nonconductive material. In a preferred embodiment, the profile is an insulating rail in the form of an aluminum rail which is coated by an insulating layer obtained through anodization. An advantage of a treated aluminum rail resides in the fact that the anodic coating can be provided in various selected colors. Colors can be chosen by use of an extruded plastic rail as the profile. The rail must be insulated from the conductive strip 11 and 12 which can be accomplished by a choice among nonconductive material for the profile rail, a coating 95 for the profile rail and/or by an insulating coating 10 around the combined conductive strips 11, 12 (FIG. 2).

The profile includes a body 31 which extends across the profile and supports opposite lateral sides 32. The sides 32 of the profile are shaped to define opposite, spaced apart inwardly facing lateral slots 33 which together define a guide channel into which the combined conductive strip 11, 12 may be slid. The edge flanges 34 above the channel hold the combined conductive strip 11, 12 in the slots 33.

An adhesive layer 36 is provided in the receiving groove 37 at the bottom of the profile 30 for enabling affixation of the rail to a surface. The protective sheet 38 over the adhesive layer 36 is removed to expose adhesive when the profile 30 is to be mounted.

The profile 30 does not block access to the lamps, or the like, supported on the contact plates 16, 22 and does not block viewing of them from the side. The alternate conductive strip support profile 40 of FIG. 7 includes a body 41 whose bottom side 42 may be adhered or applied to a surface. The side walls 43 and the top flanges 44 define the opposite spaced apart, lateral slots 45 forming the channel into which the combined strip 11, 12 (not shown in FIG. 4) may be installed by sliding in from the end, in the same manner as the strips are installed in the profile 30.

Each side wall 43 of the profile 40 supports a respective outwardly and upwardly inclined wing 50 which includes the outwardly and upwardly inclined portion 51 and the upward side wall 52. The spacing apart of the wings 50 and their heights are selected as to protect and block access to and viewing of the supported lamps or other current consuming elements from the side and also so as to not make the profile too wide. Various shapes of the wings 50 of the profile may be selected for the particular application of the profile and the combined conductive strips.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. An electrifiable ramp having an succession of pairs of electric contacts, the ramp comprising:

a bottom conductive strip;

a top conductive strip superimposed above said bottom strip;

insulating means disposed between the top and bottom conductive strips for preventing electric contact therebetween;

respective plates cut out along a lengthwise direction of each of said bottom and top conductive strips, each plate on both strips having a free end folded upwardly in the same direction form the respective strip and extending out of the plane of the strip in a first direction, wherein the plates of the top conducive strip extend above the top conductive strip and the plates of the bottom conductive strip also extend above the top conductive strip;

means disposed on the free end of each of the plates for positioning an electric contact of a current consuming element and a profile including conductive strip holding means for receiving the top and bottom superimposed conductive strips, whereby the strips may be supported by the profile for application with the profile to a selected installation.

2. The electrifiable ramp of claim 1, further comprising means for electrically insulating the superimposed conductive strips from the profile.

3. The electrifiable ramp of claim 1, wherein the top strip has slots therethrough for receiving the through passage of the upwardly extending plates of the bottom strip.

4. The electrifiable ramp of claim 1, wherein the profile is comprised of anodized aluminum.

5. The electrifiable ramp of claim 1, wherein the profile is comprised of a plastic material.

6. The electrifiable ramp of claim 1, further comprising means disposed on the profile for adhering the profile to another surface.

7. The electrifiable ramp of claim 1, wherein the profile is shaped such that the superimposed bottom and top conductive strips may be slid into the profile.

8. The electrifiable ramp of claim 7, wherein the profile has a channel for receiving the superimposed bottom and top strips.

9. The electrifiable ramp of claim 7, wherein the profile has lateral slots defined therein, said slots being shaped and positioned for defining a channel for holding the superimposed strips in the profile.

10. The electrifiable ramp of claim 1, wherein the profile has lateral sides along its length and further includes wings disposed at the lateral sides of the profile, the wings extending up in the first direction past the plates for blocking access past the wings to an electrifiable object supported on the plates.

11. The electrifiable ramp of claim 2, further comprising an electric power supply connected with the top strip and with the bottom strip for electrically powering the conductive strips.

12. An electrifiable ramp having an succession of pairs of electric contacts, the ramp comprising:

a bottom conductive strip;

a top conductive strip superimposed above said bottom strip;

insulating means disposed between said top and bottom conductive strips for preventing electric contact therebetween;

respective plates cut out along a lengthwise direction of each of said bottom and top conductive strips, each plate having a free end folded upwardly from the respective strip an extending out of the plane of the strip in a first direction, wherein said plates of said bottom conductive strip extend above said top conductive strip;

means disposed on the free end of each of said plates for positioning an electric contact of a current consuming element; and a profile including lateral slots defining a channel for receiving said top and bottom superimposed conductive strips, whereby the strips may be supported by the profile for application with the profile to a selected installation.

13. The electrifiable ramp of claim 12, wherein the insulating means comprises an insulating layer coated on at least one of the top and bottom conductive strips for insulating the strips from the profile.

14. An electrifiable ramp having an succession of pairs of electric contacts, the ramp comprising:

a bottom conductive strip;

a top conductive strip superimposed above said bottom strip;

insulating means disposed between said top and bottom conductive strips for preventing electric contact therebetween;

respective plates cut out along a lengthwise direction of each of said bottom and top conductive strips, each plate having a free end folded upwardly from the respective strip an extending out of the plane of the strip in a first direction, wherein said plates of said bottom conductive strip extend above said top conductive strip;

means disposed on the free end of each of said plates for positioning an electric contact of a current consuming element;

a profile including conductive strip holding means for receiving said top and bottom superimposed conductive strips, whereby the strips may be supported by the profile for application with the profile to a selected installation, said profile including lateral sides along its length and further including wings disposed at said lateral sides, said wings extending upward int he first direction above the plates for blocking access past the wings to an electrifiable object supported on the plates.

15. The electrifiable ramp of claim 1, further comprising an adhesive disposed between the superimposed conductive strips for adhering the strips together.

16. The electrifiable ramp of claim 1, wherein the insulating means disposed between the strips comprises a layer of adhesive material.

17. The electrifiable ramp of claim 1, wherein the plates of the top conductive strip are folded up form the top strip and the plates of the bottom conductive strip are folded up from the bottom strip in opposite directions.

18. The electrifiable ramp of claim 1, wherein the means disposed on each plate for position in an electric contact comprises a plurality of legs formed at the free end of the plate, with one leg being deformed generally out of the plane of the plate to define a mechanical support for the current consuming element.

19. The electrifiable ramp of claim 1, wherein the means for positioning the electric contact comprises a rider attached on the contact plate, the rider having three supporting legs.

* * * * *